United States Patent [19]

Cutts et al.

[11] Patent Number: 4,513,485

[45] Date of Patent: Apr. 30, 1985

[54] METHOD FOR SPLITTING TEXTILE WARP YARN SHEETS

[76] Inventors: William H. Cutts, P.O. Box 748, Clemson, S.C. 29631; Scott O. Seydel, 80 Broad St., NW., Atlanta, Ga. 30303

[21] Appl. No.: 308,449

[22] Filed: Oct. 5, 1981

[51] Int. Cl.[3] ..... D06B 1/14; D06B 1/16

[52] U.S. Cl. ..... 28/181; 118/266; 427/429

[58] Field of Search ..... 28/178, 180, 181, 182, 28/183; 118/259, 266; 427/429

[56] References Cited

U.S. PATENT DOCUMENTS

| | | | |
|---|---|---|---|
| 346,636 | 8/1886 | Blake | 28/183 X |
| 2,074,745 | 3/1937 | Griffin | 28/183 X |
| 2,438,084 | 3/1948 | Wood | 28/180 |
| 2,565,407 | 8/1951 | Still | 28/180 |
| 2,675,601 | 4/1954 | Still | 28/180 |
| 2,781,021 | 2/1957 | Schmitz | 118/266 X |
| 3,157,536 | 11/1964 | Caines | 118/266 X |
| 3,306,254 | 2/1967 | Keith | 118/259 X |
| 3,406,437 | 10/1968 | Tew | 28/180 |
| 3,553,006 | 1/1971 | Beau et al. . | |
| 3,732,603 | 5/1973 | Illman et al. | 28/181 |
| 4,200,533 | 4/1980 | Gaddis et al. . | |
| 4,268,550 | 5/1981 | Williams, Jr. | 427/429 |
| 4,364,157 | 12/1982 | Cutts | 28/179 |

FOREIGN PATENT DOCUMENTS

| | | | |
|---|---|---|---|
| 620913 | 5/1961 | Canada | 28/178 |
| 23955 | of 1893 | United Kingdom | 28/178 |
| 742308 | 12/1955 | United Kingdom | 28/178 |

*Primary Examiner*—Robert Mackey

[57] ABSTRACT

A method and apparatus are disclosed for use in the process of treating yarns which includes passing the yarns through a slashing machine (10) and applying a sizing solution to the yarns (20) arranged in side-by-side sheet form, (W), in preparation for weaving on a loom followed by drying the yarns, wherein the apparatus comprises a lease rod (A) for splitting yarns into sheets which includes a porous outer layer (32) and yarn contacting surface (34) having a capacity to sweat a liquid lubricant at a sufficiently precise rate as to control the amount of lubricant wetting the yarn contacting surface. Sticking of sizing material to the yarn contacting surface as occurs with wet yarns coated with concentrated sizing solutions is avoided without weakening the size coatings on the yarns. A source of lubricant is provided (at B) and supply means (C) supplies lubricant from said source (B) in response to the operation and speed of said slashing machine to sweat a proper amount of lubricant onto said yarn contacting surface avoiding overwetting of yarn. Alternately, compressed air may be provided (at B) instead of lubricant and admitted to the interior of the hollow lease rod for blowing off any size coating tending to accumulate on the yarn contacting surface. Sleeve (41) is adjusted over pipe (30) up to the edge of sheets (W1, W2) to expose only that length of porous yarn surface (34) that actually contacts the yarn.

12 Claims, 4 Drawing Figures

METHOD FOR SPLITTING TEXTILE WARP YARN SHEETS

BACKGROUND OF THE INVENTION

The invention relates to a method and apparatus for use in the treatment of warp yarns in preparation for weaving the yarns on a loom which includes applying a sizing composition to the yarns. The method and apparatus of the present invention have particular application where the warp yarns are treated with a concentrated sizing solution such as disclosed in United States patent application Ser. No. 285,416 filed July 22, 1981, entitled RIDER APPARATUS AND METHOD FOR APPLYING A CONCENTRATED SIZING SOLUTION TO WARP YARNS, now abandoned. Specifically, the invention resides in a method and apparatus for splitting wet warp yarns to which has been applied a sizing solution by means of bringing the sized yarns into contact with a porous lease rod having a yarn contacting surface which is wetted by the sweating of a lubricant through the porous rod.

Heretofore, rods and bars have been utilized to split warp yarns coming from a slashing machine into two or more sheets of yarns arranged generally side-by-side prior to entering a dryer apparatus whereby the yarns may be dried more individually such as shown in U.S. Pat. No. 2,565,407. However, in the process of applying a concentrated sizing solution, it has been found that the yarns come from the slashing machine with a drier, more tacky size coating which has a tendency to stick to conventional lease rods and bars. This results in an undesirable collection of sizing on the lease rods which adversely effects the splitting as well as the uniformity of the coating on the yarns, and eventually will cause ends to break and stick to the lease rods. The resulting uneven coating of sizing and resulting protruding fibers on the yarns show up in the weaving process where it tends to interfere with the air jet on a shuttleless loom and often stops the weft insertion short. This short pick results in a defect in the fabric being woven.

In U.S. Pat. No. 3,553,006, the application of a sizing composition to textile yarns has been proposed by establishing a film on a flat surface of a porous partition and passing the yarn over the surface to coat the yarn. The porous partitions are carried on pedestals which would not be a suitable arrangement for leasing.

Accordingly, an important object of the present invention is to provide a method and apparatus for splitting warp yarns into sheds to open the yarns for drying.

Still another important object of the present invention is to provide a method and apparatus for use in splitting warp yarns which have been sized which prevents sticking of the yarns to the lease rods.

Still another important object of the present invention is to provide a method and apparatus for splitting warp yarns into two or more sheds by contacting them with a lease rod having a lubricated yarn contacting surface to reduce abrasion of the yarns in weaving.

Yet another important object of the present invention is to provide a method and apparatus for splitting yarn sheets in the process of treating warp yarns which have been sized preparatory to weaving by which the size coating is not disturbed as by sticking and in which the protruding fibers are laid down by brushing across the surface of the rod so as not to interfere with the insertion of weft yarns on shuttleless looms.

Still another important object of the present invention is to provide a porous rod for splitting warp yarns being treated in preparation for weaving wherein a selected amount of lubricant is sweated by the rod to properly lubricate the yarn contacting surface.

SUMMARY OF THE INVENTION

According to the present invention, the above objectives are accomplished by providing a lease rod constructed as a stainless steel porous pipe which may have a membrane deposited internally of the pipe which allows selective passage of a lubricant through the pipe which keeps the yarn contacting surface of the lease rod coated with lubricant. Lubricant is fed internally to the pipe at a pressure proportional to the speed of the slashing machine. At machine standing conditions, the pressure is reduced to a level insufficient for continued passage of lubricant to yarn contacting surface whereby overwetting and oiling of the yarn is prevented. Alternately, regulated air may be blown through the pipe to blow off any size material from the pipe and avoid adverse accumulations.

DESCRIPTION OF THE DRAWINGS

The construction designed to carry out the invention will be hereinafter described, together with other features thereof.

The invention will be more readily understood from a reading of the following specification and by reference to the accompanying drawing(s) forming a part thereof, wherein an example of the invention is shown and wherein.

FIG. *2a* illustrates an alternate fluid source for use in the method and apparatus herein.

DESCRIPTION OF A PREFERRED EMBODIMENT

Figure 2:
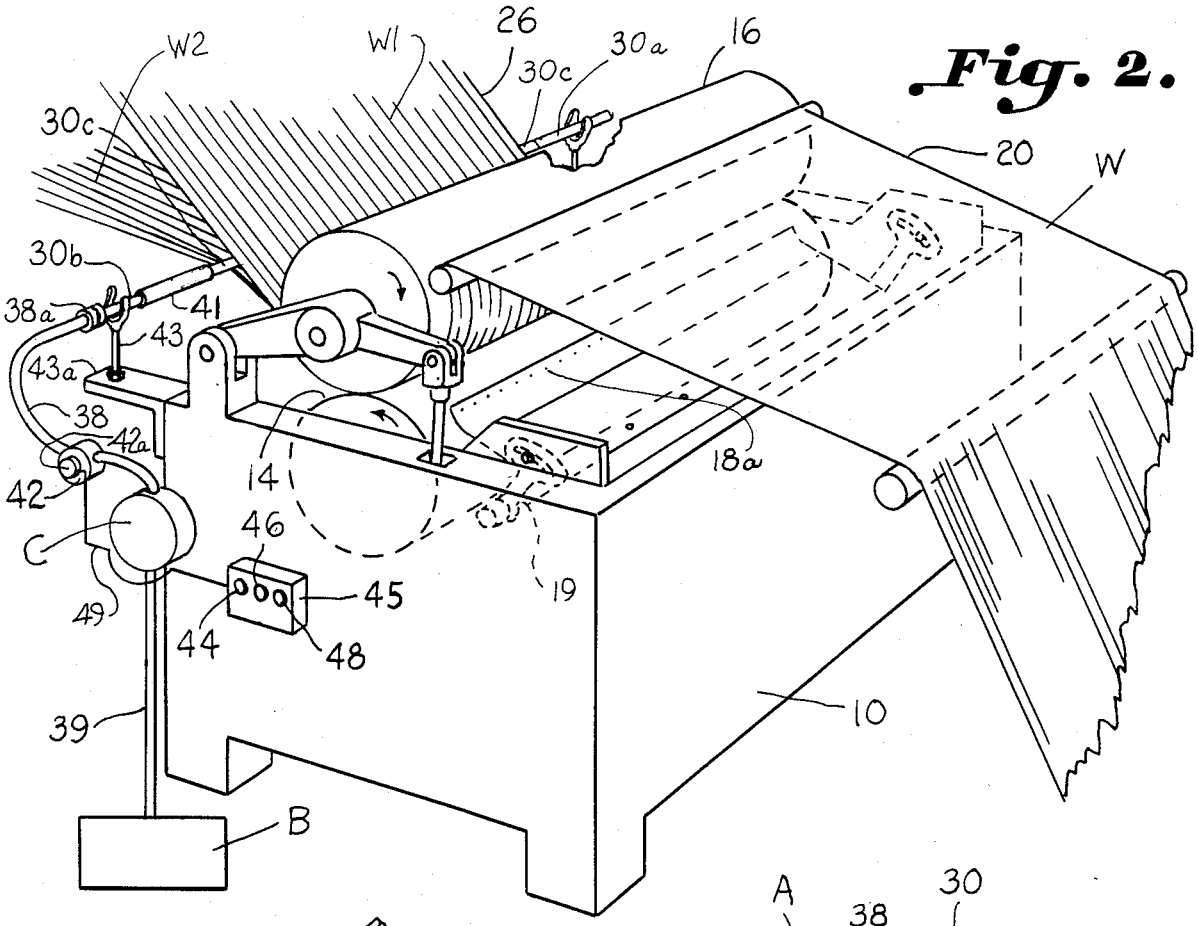
FIG. 2 is a perspective view illustrating a method and apparatus according to the present invention.

A method and apparatus for use in the process of treating warp yarns in preparation for weaving is disclosed which includes applying a coating of sizing to the yarns as they are passed generally side-by-side through a slashing maching in sheet form and subsequently passed through a dryer wherein the apparatus and method comprise splitting the sized warp yarns into two or more sheets by contacting the warp yarns with one or more lease rods A which include a porous pipe having a porous yarn contacting surface wherein the pipe has a capacity to sweat liquid lubricant at a sufficiently precise rate as to control the amount of lubricant wetting the yarn contacting surface to separate the wet sized yarns without sticking yet without over oiling. A source B of lubricant is provided and supply means C supplies lubricant from the source at a rate proportional to the speed of the slashing machine so that a proper amount of lubricant is sweated through the porous yarn contacting surface. Protruding fibers are laid and oiled down which reduces interference with weft insertion on shuttleless looms.

Referring in more detail to the drawing, a slashing machine is illustrated at 10 which may be any conventional slasher and as illustrated in a slashing machine which supplies a concentrated sizing solution to the warp yarns. The slashing machine includes a slasher box having a reservoir 12 in which a concentrated sizing solution such as 25% solids, is utilized; a pair of pressure rolls 14 and 16; and a doctoring blade 18 for removing excess size from the roll 14 which is partially immersed in the sizing and serves as an application roll. The upper roll 16 is normally a rubber roll and a proper amount of size is pressed into the warp yarns 20 as they pass generally side-by-side in a sheet form between the nip of the rollers. The doctoring edge of the blade 18 rides on a plurality of precision fulcrum abutments 18*a* about which the edge may be pivoted and set by a mechanism 19 to provide a desired spacing between the blade edge and roll 14, and hence desired film thickness thereon.

Roll 14 is a driven roll which is rotated by a conventional slasher drive arrangement in the direction indicated by the arrow which thus imparts rotation to roll 16 likewise indicated by arrow.

The warp yarns 20 are typically fed from a number of beam sections 22 located on stands 23 at the back of the slashing machine. The warp yarns from the individual warp beam sections are brought together side-by-side and passed through the slashing machine. However, it is preferred to open the sheet W of warp yarns into two or more sheets called "shedding" so that the yarns will be more open for drying.

The sized warp yarns 26 are illustrated as being split into two sheets W1 and W2 after being sized preparatory to and prior to passing through the dryer 24. As illustrated for exemplary purposes, a single sweat lease rod A, according to the invention, is utilized to split the yarns 20 into two sheets. Each lease rod includes a porous stainless steel pipe 30 which includes an outer porous layer 32 having an exterior porous surface 34 which contacts the yarn. While the term, stainless steel pipe, is used, it is to be understood that other suitable composition pipes may also be utilized. The interior of the pipe is hollow at 36 for communicating liquid lubricant to the porous yarn contacting surface 34. Deposited internally of the pipe within the portion 36 is an enamel-type membrane substance of porous material which will allow selective passage of lubricant oil through the membrane and subsequently through the porous stainless steel substance of which the rods are composed. Once the rate of flow of the lubricant oil through the porous stainless steel layer 32 is determined, the type and quantity of enamel coating applied to the inside of the hollow pipe can be determined so that the total composite structure has the capacity to sweat the liquid lubricant at a predetermined and sufficiently precise rate and pressure so as to assure that the yarn contacting surface 34 is properly coated to prevent sticking of the wet, sized yarns yet not apply an excessive amount of oil to the yarn. Suitable porous piping includes that disclosed in U.S. Pat. No. 4,200,533 which discloses porous pipe utilized in a hyperfiltration system and the disclosure of which is incorporated herein and made a part hereof by reference. Suitable piping is available from Carre, Inc. of Seneca, South Carolina.

As illustrated, pipe 30 is arranged in the shed between the yarn sheets and is joined by suitable fittings or pipe joining methods to supply line 38 and to lubricate supply means C which communicates via pipe 39 with source B. For this purpose, a conventional quick-release coupling fitting 38*a* may be utilized connecting line 38 and pipe 30. Lease rod A is supported on vertically adjustable standards 43 carried on frame 43*a* which is secured to the frame of slasher box 10. Of course, other bracket arrangements for the sweat split rods A may be used such as would permit turning to compensate for wear. Any number of rods may be used as necessitated by the number of yarn sheets desired.

End 30*a* of the pipe 30, indicated by a dotted line, is closed as by a solid plug. Generally, the pipe 30 will have a length greater than the width of yarn sheet W or W1, W2. To prevent oiling and possible dripping of that part of the porous rod surface which is not being contacted by yarn, a solid sleeve 41 may be received and clamped to that portion of the rod not utilized such as by using conventional ring or hose clamps (not shown). Sleeve 41 may be constructed of any suitable material such as plastic. A segment 30*b* of pipe 30 in a solid wall and not porous. Sleeve 41 may be of sufficient length to be adjusted backwards and forwards over segment 30*b* to provide the proper length 30*c* of exposed yarn contacting surface generally from the end of sleeve 41 to the dotted line indicating the beginning of plug 30*a*.

Any suitable lubricating oil may be utilized such as 10-W coning oil. Means for supplying the lubricant to porous leasing rod 30 includes any suitable positive displacement pump such as a conventional gear pump 40 having a pump by-pass. A pressure regulator 42 regulates the output of pump 40 in response to the speed and operating condition of slashing machine 10. A conventional slashing machine typically has three operational speeds: standing, slow and full. These are indicated on the schematic control box 45 as buttons 44, 46, and 48 which may be manually selected. The control function and speed is transmitted via control wire 49 to pressure regulator 42 to set the pressure accordingly. Regulator 42 may be a conventional Foxborough-type pressure regulator valve commonly employed in textile mills. The valve typically includes a valve body having different size fluid passages formed therein. In the application herein, control wire 49 may be connected to a three-point solenoid switch 42*a* which sets the valve 42 at the passage position correct for the operational condition of the slashing machine.

For example, at standing conditions, the pressure will be zero and the valve 42 will be closed; at slow speed, the valve will be set for a pressure of 5 to 10 p.s.i., and at full speed, 50 to 60 p.s.i. Excess fluid will be bypassed through the pump. In this manner, the flow rate of lubricating oil through porous pipe 30 will be greater as the speed of the slasher increases, thus always insuring that the proper amount of lubricating oil is sweated to wet the surface 34 of the pipe. When the slasher is standing still, continued wetting of the yarn contacting surface is terminated to avoid excessive oiling of the yarns under such conditions. This is important due to the fact over oiled yarns could result in weakening the size coating and performance of the yarns in subsequent weaving steps.

Figure 2A:
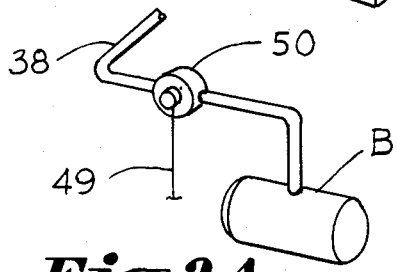
Figure 3:
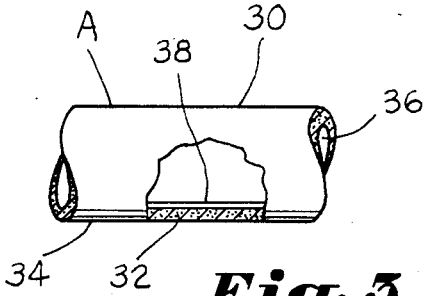
FIG. 3 is an elevational view with parts cut away illustrating a porous lease rod for use according to the present invention.
Figure 1:
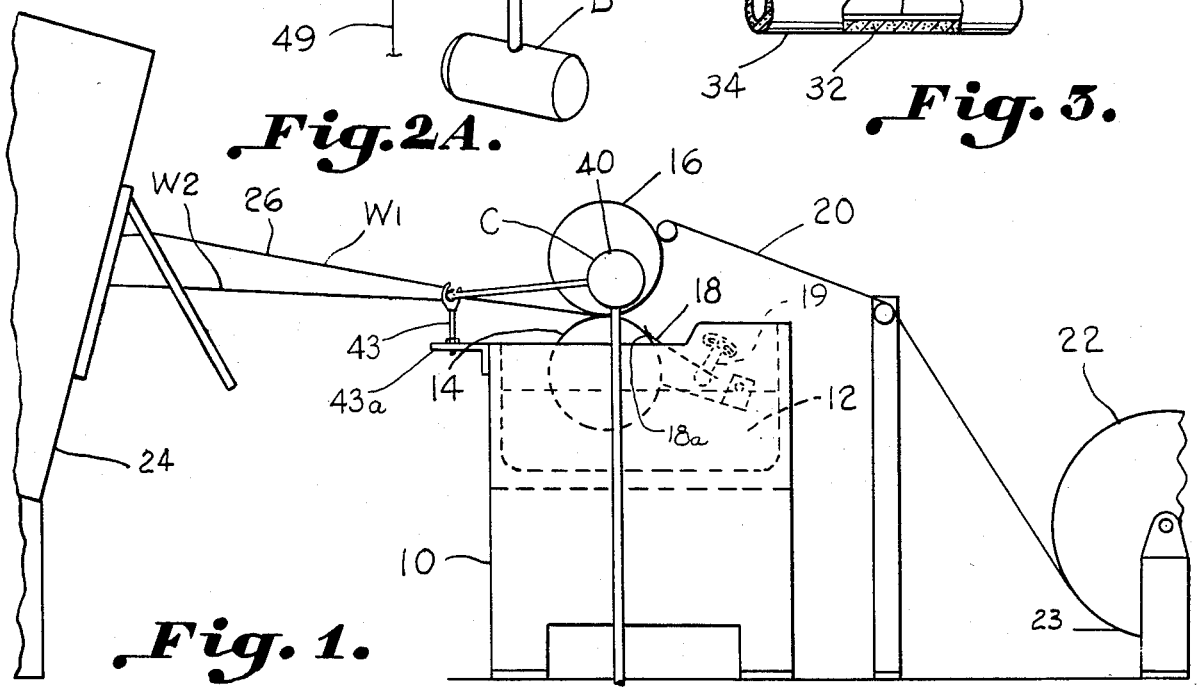
FIG. 1 is an elevational view illustrating apparatus and a method according to the invention for splitting warp yarns into a plurality of sheets in the process of treating warp yarns in preparation of weaving.

Referring to FIG. 2*a*, the use of compressed air is schematically illustrated as the fluid medium delivered through pipes 30 to avoid sticking the size to the split rods and accumulation thereon. This may be carried out by utilization of the compressed air supply normally available at weaving mills as the fluid source B and by using any suitable conventional pressure regulator at 50 operated in response to slasher control 45. For example, at standing, there will be zero pressure; and at slow and full speeds, air pressure sufficient to blow off any size material will be determined and set and regulated by regulator 50 via control wire 49. A simple, solenoid-operated two-way valve connected to control line 49 may be utilized at 50 which cuts off the supply of compressed air when the slasher is standing and opens the supply line 38 to the compressed air source B when the slasher operation is at either slow or full speed.

While the above control of pressure for either liquid lubricant or air is given by way of example, other pressure controls may be utilized as being well within the skill of the average artisan.

While a preferred embodiment of the invention has been described using specific terms, such description is for illustrative purposes only, and it is to be understood that changes and variations may be made without departing from the spirit or scope of the following claims. For example, the apparatus and method may be utilized in the treatment of yarns at other locations other than the front of the slasher.

What we claim is:

1. In a method of treating warp yarns preparatory to weaving on a loom of the type wherein a sizing solution is applied to the yarns arranged generally side-by-side in sheet form on a slashing machine followed by passing said yarns over a lease rod after application of said sizing solution splitting same into a pair of sheets defining a shed therebetween and subjecting said yarns to a drying process, the improvement comprising:

providing a hollow split lease rod including an outer porous layer having an exterior porous yarn contacting surface defined by a minute cellular pore structure so that substantially the entire yarn contacting surface of said lease rod is uniformly wetted to avoid sticking of said yarns without excessively lubricating said yarns;

placing said split rod in said shed;

splitting said yarns into said sheets by contacting said yarns with said porous yarn contacting surface; and supplying a lubricant to said porous layer at a sufficient pressure to cause said lubricant to sweat through said layer and wet said yarn contacting surface by a predetermined amount sufficient to uniformly wet said porous yarn contacting surfaces to avoid said sticking of said yarns thereagainst.

2. The method of claim 1 including decreasing the pressure of said lubricant responsive to the slashing machine being engaged in a standing condition to a level insufficient for continued delivery of lubricant to said yarn contacting surface.

3. The method of claim 1 including controlling the pressure of said lubricant responsive to the operating condition of said slashing machine.

4. The method of claim 1 including covering a portion of the length of said porous surface which is not contacted by said yarn sheets.

5. The method of claim 1 including:

utilizing as the lease rod a hollow porous metallic rod having an interior bore coated with a continuous membrane substance; and controlling the amount of lubricant delivered to said porous yarn contacting surface by selecting said membrane and pore structure to deliver said sufficient quantity of lubricant to said yarn contacting surface.

6. The method of claim 1 including:

providing an impermeable sleeve slidably carried on said porous lease rod to cover a portion of said porous yarn contacting surface and provide a porous yarn contacting surface on said lease rod equivalent generally to the width of said warp yarn sheets passing thereover.

7. A method of treating warp yarns in preparation for weaving said yarns on a loom of the type wherein a sizing solution is applied to the yarns arranged generally side-by-side in sheet form on a slashing machine followed by passing the yarns over at least one lease rod after application of said sizing solution to split the yarn sheet into a plurality of separated yarn sheets and then subjecting the yarns to a drying process, wherein the improvement comprises:

providing said lease rod having a porous outer layer and exterior yarn contacting surface defined by a minute cellular pore structure and a fluid communicating interior portion;

providing said porous exterior surface continuously over said yarn contacting surface corresponding generally to the entire width of said yarn sheets so that all of said yarns are prevented from sticking essentially continuously over said entire yarn contacting surface;

providing a source of fluid communicating with said interior portion; and pressurizing said fluid to maintain fluid flow by sweating through said porous layer of sufficient quantity to form a fluid layer on said yarn contacting surface and prevent sticking of said sizing solution to said yarn contacting surface without excessive application of said fluid to said yarns.

8. The method of claim 7 wherein said fluid is air.

9. The method of claim 7 wherein said fluid is a liquid lubricant.

10. The method of claim 7 including:

providing an impermeable sleeve slidably carried on said porous lease rod to cover a portion of said porous yarn contacting surface and provide a porous yarn contacting surface on said lease rod equivalent generally to the width of said warp yarn sheets passing thereover.

11. The method of claim 7 including covering a portion of the length of said porous surface which is not contacted by said yarn sheets.

12. The method of claim 11 including:

utilizing as the lease rod a hollow porous metallic rod having an interior bore coated with a continuous membrane substance; and controlling the amount of fluid delivered to said porous yarn contacting surface by selecting said membrane and pore structure to deliver said amount of fluid to said yarn contacting surface.

* * * * *